United States Patent [19]

Sumi et al.

[11] 4,149,256

[45] Apr. 10, 1979

[54] ANALOG SIGNAL PROCESSING SYSTEM

[75] Inventors: Akira Sumi; Koju Kataoka, both of Musashino, Japan

[73] Assignee: Yokogawa Electric Works, Ltd., Tokyo, Japan

[21] Appl. No.: 829,505

[22] Filed: Aug. 31, 1977

[30] Foreign Application Priority Data

Sep. 7, 1976 [JP] Japan ..... 51/107074

[51] Int. Cl.[2] ..... G06J 1/00

[52] U.S. Cl. ..... 364/602; 340/347 M; 340/347 AD; 340/347 SH

[58] Field of Search ..... 364/600, 601, 602, 607, 364/608; 340/347 NT, 347 SH

[56] References Cited

U.S. PATENT DOCUMENTS

| | | | |
|---|---|---|---|
| 3,670,308 | 6/1972 | Tutelman | 340/172.5 |
| 3,673,392 | 6/1972 | Holm | 364/602 X |
| 3,789,199 | 1/1974 | Kotwicki | 364/602 |
| 3,872,389 | 3/1975 | Willard | 364/602 X |
| 3,894,219 | 7/1975 | Weigel | 364/602 |

*Primary Examiner*—Joseph F. Ruggiero

*Attorney, Agent, or Firm*—Parmelee, Johnson, Bollinger & Bramblett

[57] ABSTRACT

Computations are performed on the digital representation of an analog signal in a digital processor. The output of the processor is applied through a digital/analog converter to a sample and hold circuit. The analog signal is applied to the processor through a comparator which receives at a second input the output of the digital/analog converter. In a mode other than the computation mode the processor controls an analog/digital conversion by means of a loop including the processor, the digital/analog converter, and the comparator.

9 Claims, 14 Drawing Figures

20 PROCESSOR
22
DATA MEMORY
21
INPUT PORT
23
CENTRAL PROCESSOR UNIT
24
PROGRAM MEMORY
25
OUTPUT PORT
30
D/A CONVERTER
70 SLOPE SIGNAL GENERATOR
71
72
S
41
42
43
40
50
COMPARATOR
10
(e_I)
(e_f)

ANALOG SIGNAL PROCESSING SYSTEM

BACKGROUND OF THE INVENTION

1. Field of the Invention

The present invention relates to an analog signal processing system which receives an input analog signal and performs various operations including addition, subtraction, multiplication and division by the use of processors such as micro-computers.

2. Description of the Prior Art

As a result of recent progress in digital circuit technology, processors such as small-sized micro-computers have been made available at lower cost, with consequent widening of the fields of application. In utilizing these processors with an analog system, it generally is necessary to provide an analog/digital converter (hereinafter referred to as A/D converter) on the input side of each processor for converting an analog signal to a digital signal, and also a digital/analog converter (hereinafter referred to as D/A converter) on the output side for converting a digital signal to an analog signal. Since the A/D converter is expensive and has a complicated circuit configuration, there exists a disadvantage that if an A/D converter and a micro-computer are employed to constitute a system, the entire equipment also turns out to be complicated, with increased cost. Particularly in the case where a plurality of input signals are processed, it is necessary to provide as many A/D converters as there are input signals, or to incorporate a multiplexer and perform analog-to-digital conversion after switching the input signals by the multiplexer, hence rendering the overall structure extremely intricate.

SUMMARY OF THE INVENTION

A principal object of the present invention is to provide an improved analog signal processing system which requires neither an A/D converter nor a multiplexer on the input side of a processor for dealing with input analog signals, thereby to achieve a simplified structure and low cost of construction.

A further object of the invention is to provide an improved analog signal processing system which is capable of holding the result of a computation even in the event of interruption of the power supply and, upon restoration of the power supply, continuously producing the result obtained immediately before such power interruption.

Yet another object of the invention is to provide an improved analog signal processing system capable of performing rapid and high-resolution conversion of an analog signal to a digital signal.

DESCRIPTION OF THE PREFERRED EMBODIMENTS

Figure 1:
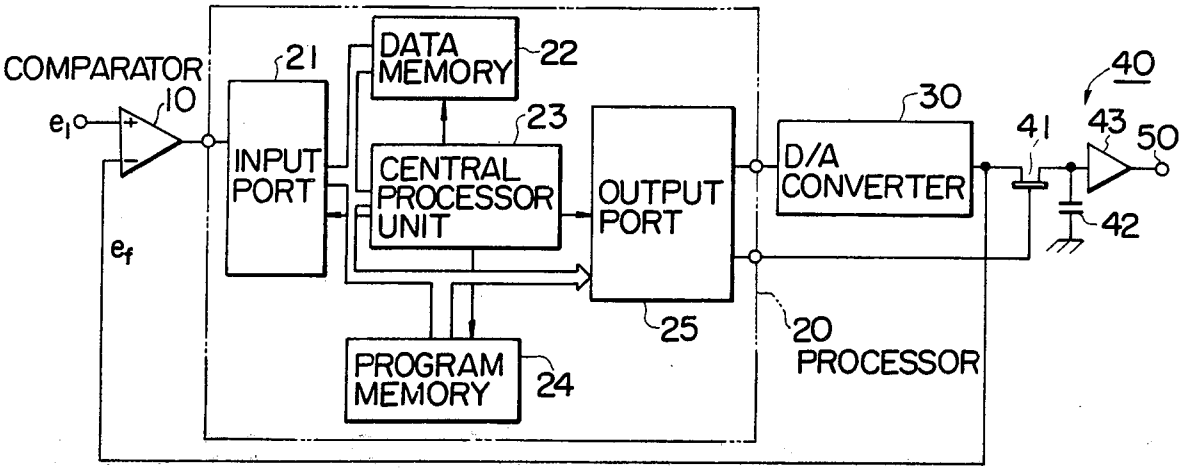
FIG. 1 is a block diagram of an exemplary system embodying the present invention.

In the block diagram of FIG. 1 showing an exemplary embodiment of the present invention, an analog signal el is applied to a comparator 10 through one input terminal, and the comparator output is supplied to processor 20 such as a micro-computer. A D/A converter 30 converts the digital signal of processor 20 to an analog signal fed to the other input of the comparator 10. An analog signal sample and hold means 40 also is provided in the form of a semi-conductor switch 41, a capacitor 42 and an amplifier 43.

The comparator 10 compares the analog signal el with the analog signal ef, and feeds the result of this comparison an an input signal to the processor 20. This processor includes an input port 21, a data memory 22 such as read-write memory, a central processor unit 23, a program memory 24 such as a read-only memory, and an output port 25. The input port 21 receives the output signal of the comparator 10 and keeps this signal therein until it is loaded by the signal from the central processor unit 23.

The data memory 22 temporarily stores the signal obtained from the input port 21 or stores the result of the computation in response to the signal from the central processor unit 23. The program memory 24 has previously stored in it the procedural steps for converting an analog signal to a digital signal, the procedural steps for controlling the peripheral circuits, various computing procedures and also data required for computation. The content of program memory 24 is read out by the signal from the central processor unit 23. The central processor unit 23 fetches the state of the signal fed to the input port 21 and writes the signal state into the data memory 22, or decodes the computing procedure from the program memory 24, or performs digital computation by using the data read out from the program memory 24 or the signal obtained from the data memory 22.

The output port 25 receives the digital signal from the data memory 22 or the central processor unit 23 and feeds a digital signal to the D/A converter 30 in response to the signal obtained from the central processor unit 23, or feeds a control signal to the analog signal hold circuit 40 to control the same. The D/A converter 30 converts the digital signal of the output port 25 to an analog signal and feeds it to the other input terminal of the comparator 10, and further functions to apply the analog signal to the analog signal hold means 40 when the switch 41 is turned on by an output instruction signal (control signal) from the processor 20.

Figure 2:
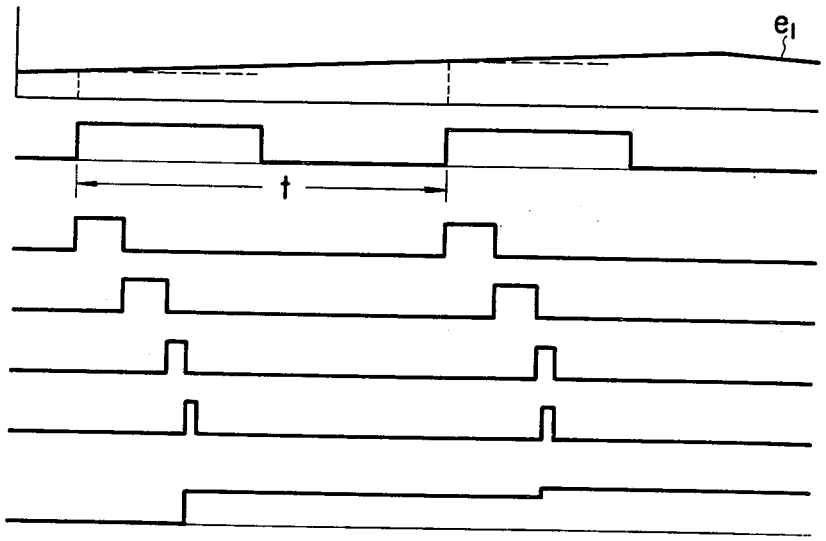
FIG. 2 is a time chart for explaining the operation of the system shown in FIG. 1.

The operation of the system having the above-mentioned structure now will be described below with reference to the time chart of FIG. 2. FIG. 2 (*a*) is an input analog signal e1, and FIG. 2 (*b*) is a sampling clock signal for general control of the operation in the digital processor 20. The period t of this sampling clock signal is determined in consideration of the variation speed and so forth of the input analog signal e1. First, as shown in FIG. 2 (*c*), the processor fetches the output signal of comparator 10 at the rise of the sampling clock signal in accordance with the signal (program) stored in the program memory 24, and the input analog signal applied to the input terminal of comparator 10 is converted to a digital signal by the analog/digital conversion loop consisting of comparator 10, processor 20 and D/A converter 30.

Figure 3:
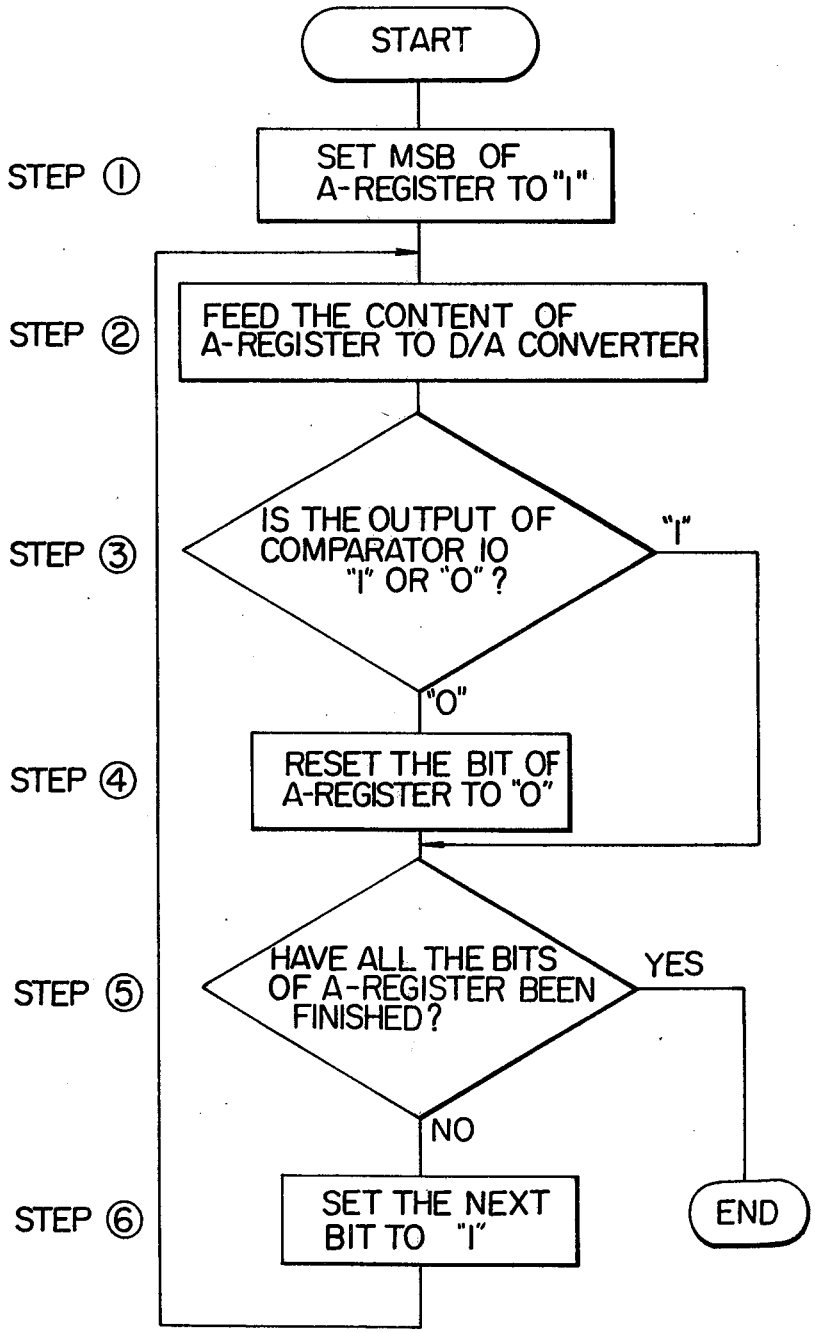
FIG. 3 is a flow chart showing an example of a converting procedure in the case where a processor converts an input analog signal to a digital signal.

Among a variety of methods known for conversion of an input analog signal to a digital signal, there is, for example, sequential comparison in which conversion is performed as shown in the flow chart of FIG. 3. (1) The most significant bit in an A-register formed in a portion of the central processor unit 23 is set to "1", so that the digital amount corresponding to 50 percent of the total capacity of the A-register is set therein. (2) Subsequently, the content of the A-register is fed to the D/A converter 30, so that the digital amount corresponding to the said 50 percent is converted to an analog amount by the D/A converter 30, and the analog signal $e_f$ is applied to the other input terminal of comparator 10. (3) Then, the output signal of the comparator 10 is loaded for discrimination of its state. (4) If the state of the signal thus loaded is "0". or $e_1 < e_f$, the most significant bit of the A-register set to "1" initially is reset to "0". And if the signal state is "1", or $e_1 > e_f$, the most significant bit of the A-register set to "1" initially is left unchanged. (5) The A-register is checked to decide whether the above procedure is terminated for all the bits, and if it is not yet terminated, (6) the next bit or the second bit weighted half to the most significant bit is set to "1". This completes setting of the digital signal corresponding to 25 percent or 75 percent of the total capacity in the content of A-register. Here, the procedure returns to (2) again, and the steps from (2) to (6) are repeated in the same manner as the foregoing. This time, the third bit is set to "1" in step (6). In this manner, the steps from (2) to (6) are executed continuously until all the bits of the A-register are terminated, that is, until the least significant bit is set to "1" or "0". The procedure is completed upon termination of all the bits, and the content remaining in the A-register represents the value of the digital signal converted from the input analog signal $e_1$.

The digital signal thus obtained is processed in a desired operation such as addition, subtraction, multiplication, division or square root extraction as shown in FIG. 2 (*d*) by using the data in the data memory 22 or the data in the program memory 24 in accordance with the program stored in the program memory 24. The operation to be executed depends on the content of the program stored previously in the program memory 24. Upon completion of the predetermined computation, the result is fed to the D/A converter 30 through the output port 25 as shown in FIG. 2 (*e*) and is converted to an analog signal. Subsequently, as shown in FIG. 2 (*f*), an output instruction signal is fed to the sample hold switch 41 so that the analog signal from the D/A converter 30 is applied to the analog signal hold means 40. Thus, the result of computation in the form of analog signal such as shown in FIG. 2 (*g*) can be obtained continuously from the output terminal 50. In this case, the analog signal from D/A converter 30 is applied also to the other input terminal of comparator 10, but it is not concerned at all since the output signal of comparator 10 is not loaded in the processor 20.

In the system of the present invention, constructed as described above, the processor performs time-sharing control on A/D conversion, predetermined computation, output to the D/A converter and control signal (output instruction signal) to the analog signal hold means, hence eliminating the necessity of installing any expensive A/D converter on the input side of the processor and consequently simplifying the whole structure with reduction of the cost.

Figure 6:
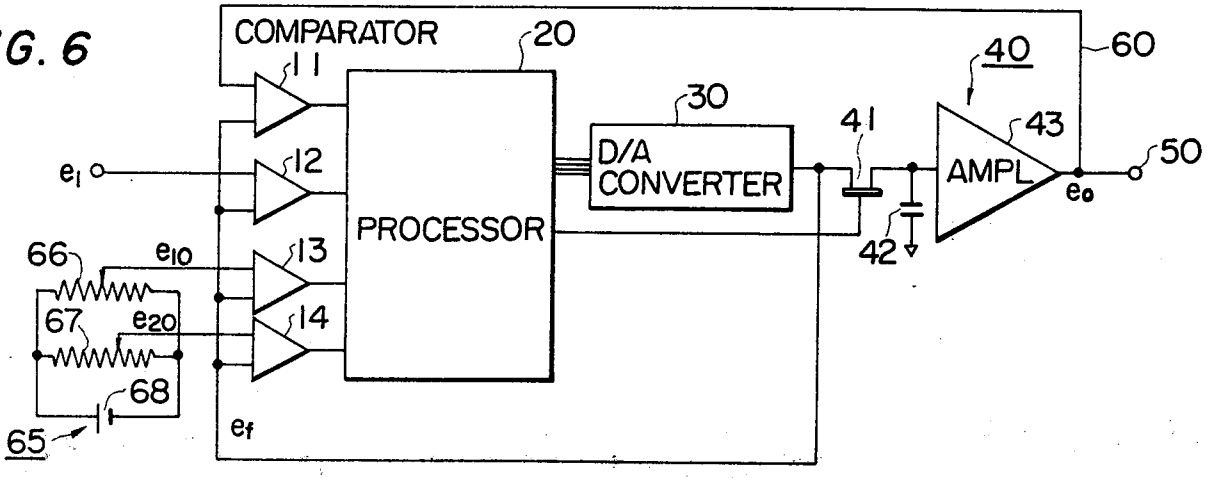
FIGS. 4 through 6 are block diagrams of other embodiments of the invention.
Figure 4:
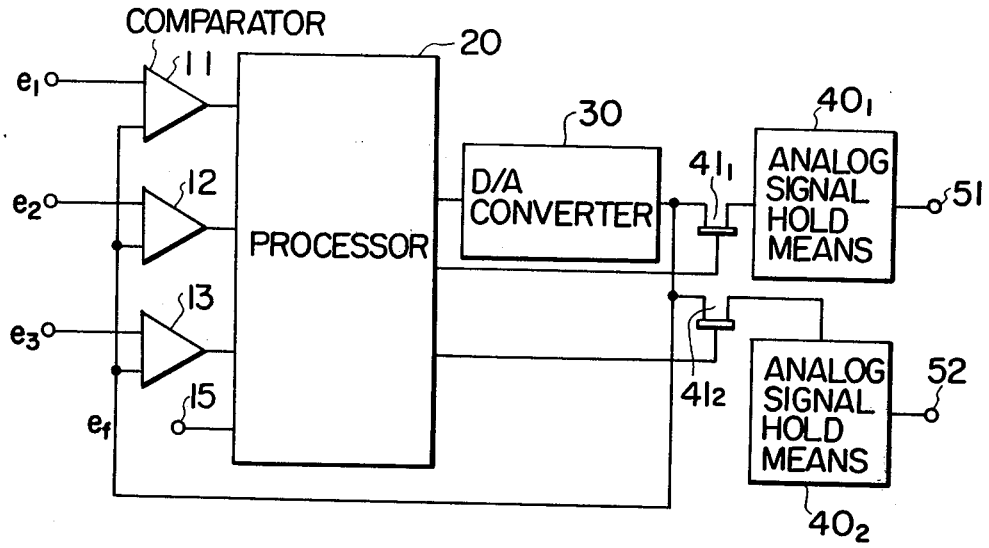
Figure 5:
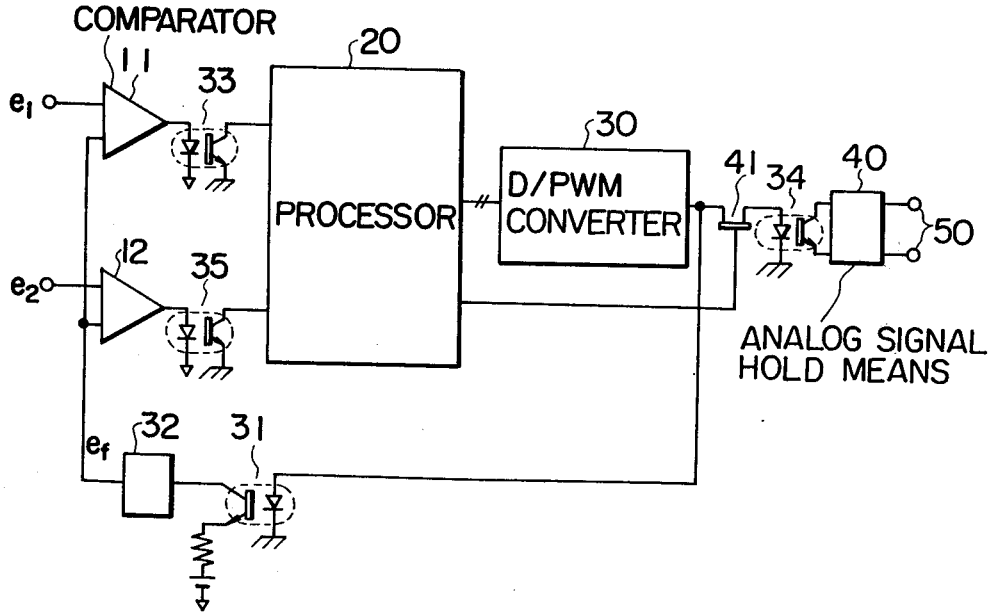

FIGS. 4 through 6 are block diagrams of other examples embodying the present invention.

The embodiment of FIG. 4 shows the case where a plurality of input analog signals are received and a plurality of output analog signals are produced. In this system, three comparators 11, 12, 13 are installed on the input side of a processor 20, and analog signals e1, e2, e3 are applied to the corresponding comparators 11, 12, 13 individually through one input terminal thereof while an analog signal $e_f$ from a D/A converter 30 is applied to each comparator in common through the other input terminal. A terminal 15 is provided on the input side of processor 20 so as to apply an interrupt signal for changing instruction procedure or computing procedure from an operation control unit or to apply a digital input signal for effecting allocation by a program. Moreover, two analog signal hold means $40_1$, $40_2$ are installed on the output side of D/A converter 30.

In this embodiment, the processor 20 first converts the analog signals e1, e2, e3 sequentially to digital signals according to the procedure of FIG. 3, and then stores the digital signals in a portion of a data memory. Subsequently, the digital signals stored previously in the data memory are read out to execute predetermined computation. The result is written in a portion of the data memory or is delivered through the output port and the D/A converter 30. The result of adding e1 and 32, for example, is fed to the analog signal hold means $40_1$, and the result of multiplying the sum of e1 and e2 by e3, for example, is fed to the analog signal hold means $40_2$.

The procedure may be so changed that the processor 20 first converts the input analog signals e1, e2 to digital signals, then makes a computation using the digital signals representative of e1 and e2, subsequently converts the input analog signal e3 to a digital signal, and executes the predetermined computation again. Such a change of the procedure is achievable by the program stored in the program memory, or by the interrupt signal applied to the terminal 15, or by the digital input signal serving to effect allocation according to the program.

In the case where input analog signals are plural as in this embodiment, it is possible to economize on the capacity of the data memory by a procedure in which, instead of converting all the input analog signals in the beginning, an analog-to-digital conversion is performed of only the input analog signal required during computation and subsequently repeating the computation. Depending on the result of computation, it is further possible to omit the computation of the remaining input analog signals. In such a case, the computing speed can be increased.

According to the system of the present invention, even when the number of input analog signals is plural as in this embodiment, it is necessary merely to provide comparators on the input side of the processor. There exists another merit that even when the number of output analog signals is plural, it is necessary merely to provide an analog signal hold means on the output side of the D/A converter. Moreover, due to the terminal 15 provided on the input side of the processor, instruction procedure or computing procedure from the operation control unit is properly changeable by the interrupt signal or the digital input signal serving to effect allocation according to the program.

In the embodiment of FIG. 5, the output side of a processor 20 is equipped with a digital/pulse width converter 30 which is a kind of D/A converter to convert a digital signal to a pulse-width signal, and this signal is applied to the other input terminals of comparators 11, 12 in common through an isolation means 31 such as phototransistor and a smoothing circuit 32. The outputs of the comparators 11, 12 are fed to the processor 20 through an isolation means 33, and the output of digital/pulse width converter 30 is fed through an isolation means 34 to an analog signal hold means 40 including a smoothing circuit. Thus, it is another advantage of the system of the present invention that, as in this embodiment, the input side and the output side can be easily isolated from each other by conversion of the digital signal from the processor to a pulse-width signal.

In each of the foregoing embodiments, the result of computation is obtained through the analog signal hold means. However, if necessary, the structure may be so modified as to obtain the result in the form of digital signal from the processor 20.

The embodiment of FIG. 6 is equipped with means 60 to feed the output signal of an analog signal hold means 40 to one input terminal of a comparator 11. Furthermore, it is also equipped with an operation parameter setting circuit 65 consisting of variable resistors 66, 67 and a direct current source 68, wherein analog set signals e10, e20 obtained from the setting circuit 65 are applied to the corresponding comparators 13, 14 individually through one input terminal thereof.

Supposing now that a power source (not shown) connected to the processor 20 causes interruption of power supply in this embodiment, a switch 41 is turned off so that the result of computation immediately before the power interruption is held in the form of analog value in a capacitor 42. The value thus held is maintained substantially constant except for the change resulting from slight leakage of the capacitor 42. When the power source resumes its normal state to place the processor 20 into operation, the processor first loads the output analog signal $e_0$ of the analog signal hold means 40, which represents the result of computation individually before the power interruption, through the comparator 11 and converts the signal $e_0$ to a digital signal by an A/D conversion loop consisting of the comparator 11, the processor 20 and the D/A converter 30. The digital signal thus obtained is stored in a portion of the data memory, and is used as the initial value of computation when required or is fed as the hold output value to the analog signal hold means 40 through the D/A converter 30 and the switch 41. And even after restoration of the power supply, the result of computation immediately before the interruption can be produced continuously from the output terminal 50. The operation parameter does not become extinct at the occurrence of power interruption since it is set by the variable resistors as an analog value.

Figure 7:
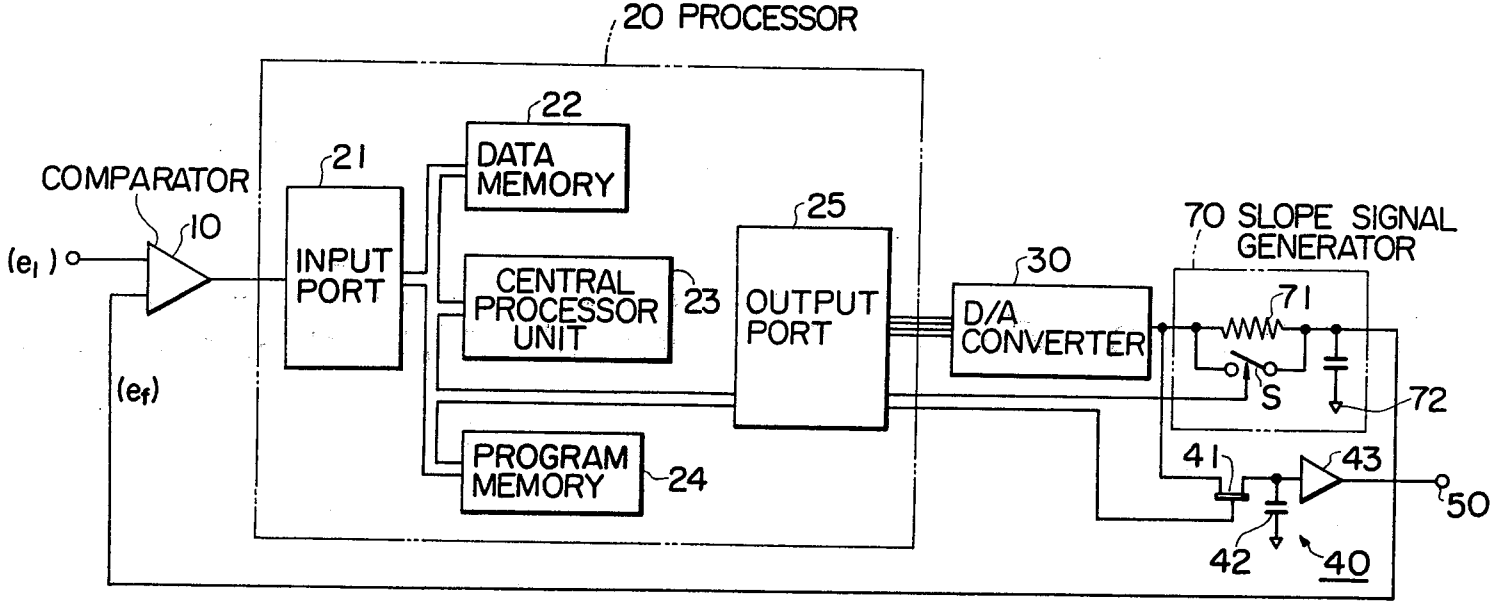
FIGS. 7, 11 and 14 are block diagrams of further embodiments of the invention where circuits are additionally connected to enhance the resolution in analog-to-digital conversion.
Figure 8:
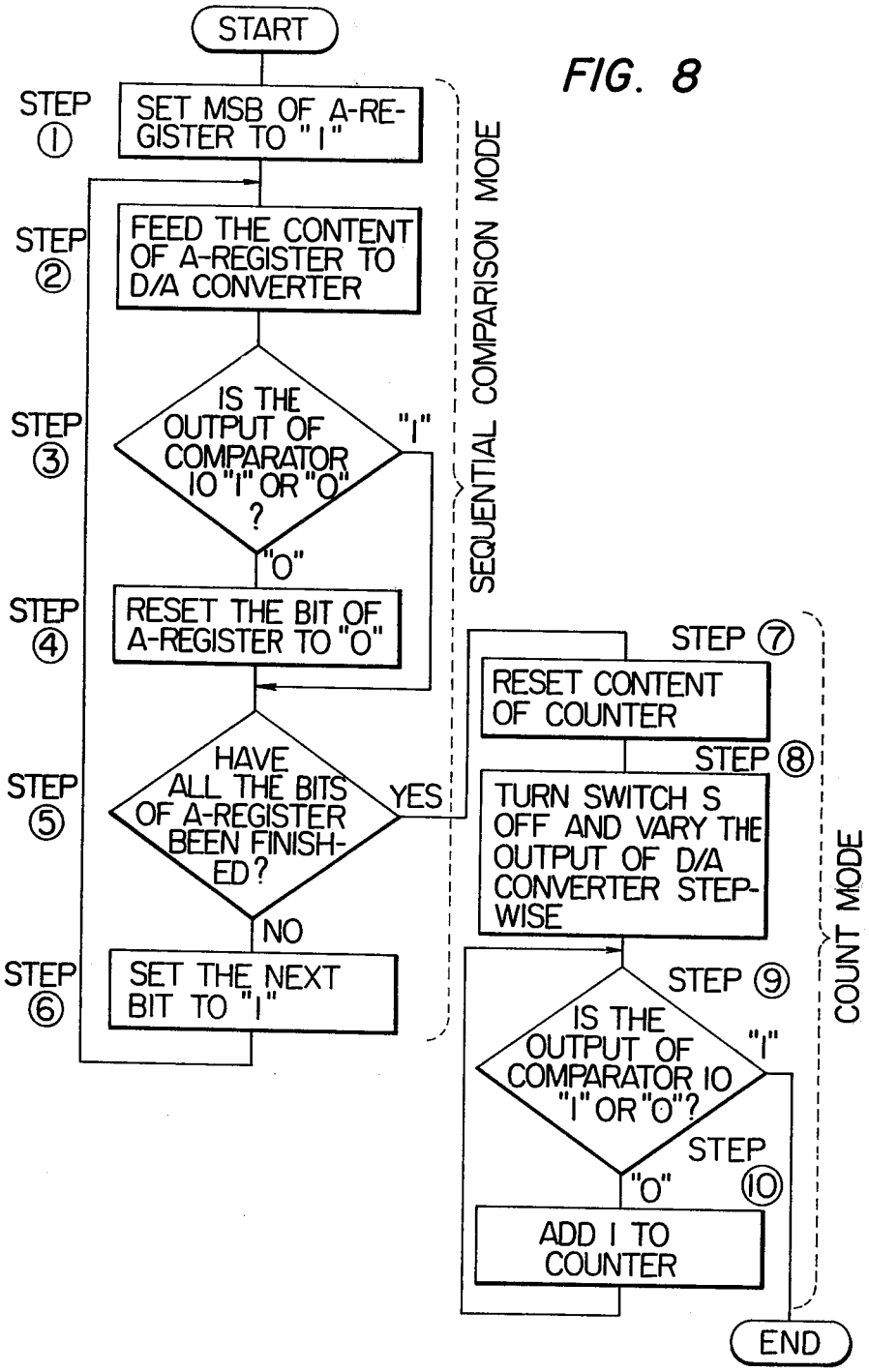
FIG. 8 is a flow chart showing an example of the processor operation in the embodiment of FIG. 7.
Figure 9:
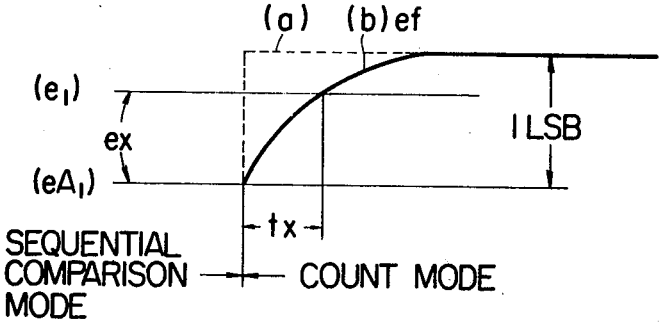
FIG. 9 is an explanatory diagram plotting the operation in a count mode.

In the embodiment of FIG. 7, a slope signal generator 70 for generating a slope signal by changing the output of a D/A converter 30 stepwise in response to the signal from a processor 20 is connected to the output side of the D/A converter 30. The slope signal generator 70 comprises an integrating circuit, which consists of a resistor 71 and a capacitor 72, and a switch S connected in parallel with the resistor 71. A comparator 10 compares an analog signal $e_1$ applied to one input terminal with a signal $e_f$ applied to the other input terminal from the slope signal generator 70, and feeds the result of comparison as an input signal to the processor 20. Here, the processor 20 employed is such that it has at least a sequential comparison function and a count function. The D/A converter 30 converts the output digital signal of processor 20 to an analog signal and feeds it to the analog signal hold means 40 through the switch 41 while feeding it simultaneously to the other input terminal of comparator 10 through the slope signal generator 70. In this embodiment, the slope signal is the one generated by utilizing the stepped output of the D/A converter, and it generally denotes a temporary lagging signal, a sawtooth signal or a triangular signal increasing and/or decreasing continuously with the lapse of time. The amplitude (final value) of such signal corresponds to an integral multiple of one LSB (least significant bit) of the A/D converter 30. In converting an input analog signal to a digital signal, the system of the above-described structure first performs an A/D conversion in a sequential comparison mode with no slope signal being generated, and then executes A/D conversion in a count mode with the generation of slope signal. At the time of A/D conversion, the switch 41 is kept turned off. Hereinafter the action of A/D conversion in this system will be described in detail with reference to the flow chart of FIG. 8. First, the system is placed in a sequential comparison mode for A/D conversion. In this mode, the processor 20 turns on the switch S of the slope signal generator 70 so as not to generate any slope signal, and converts the input analog signal $e_1$ to a digital signal through sequential comparison by a loop including the comparator 10, the processor 20 and the D/A converter 30. In the sequential comparison mode, the steps (1) through (6) are the same as those in the flow chart of FIG. 3. At the termination of these steps in the sequential comparison mode, the content D1 remaining the A-register becomes the value of the digital signal obtained by converting the input analog signal $e_1$ through sequential comparison, and its resolution is equivalent to the number of bits of the D/A converter 30. Subsequently, the system proceeds to a count mode for A/D conversion. In this mode, the processor 20 first resets the content of a counter formed in a portion of the central processor unit 23 (Step (7)). The switch S of slope signal generator 70 is turned off, and simultaneously the output signal of D/A converter 30 is varied stepwise by, for example, one least significant bit of D/A converter (Step (8)). Thus, the output of D/A converter 30 is varied as shown in FIG. 9(*a*), and the output $e_f$ of slope signal generator 40 is shaped into a slope signal which has an amplitude of one LSB and, as plotted in FIG. 9 (*b*), increases toward the output signal of D/A converter with the lapse of time at the time constant of resistor 71 and capacitor 72. Next, the processor 20 loads the output signal of comparator 10, and discriminates the state of this signal (Step (9)). And if the state of the signal thus loaded is "0" or $e_1 > e_f$, 1 is added to the counter (Step (10)). Steps 9 and 10 are repeated until the state of the comparator output signal becomes "1", that is, until coincidence is attained between the input analog signal $e_1$ and the signal $e_f$ from slope signal generator 40. When the condition $e_1 \leqq e_f$ is obtained, the count mode is terminated. At this time, the content D2 remaining in the counter represents $t_x$ (time required until coincidence is attained betweee$_1$ and $e_f$ after generation of slope signal) shown in FIG. 9, and this value corresponds to $e_x$ (position of input analog signal $e_1$ within one LSB). The relationship among them is expressed as follows:

$$\log e_x \propto t_x \propto D2.$$

Figure 10:
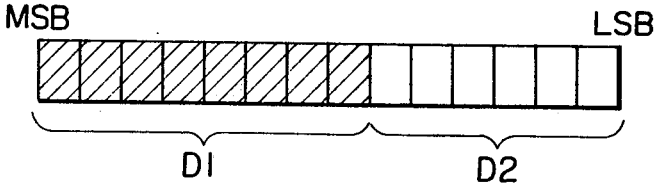
FIG. 10 is a conceptional diagram of a digital signal obtained through conversion.

Consequently, as illustrated in FIG. 10, the processor 20 adds the digital signal D2 obtained in the count mode to the digital signal D1 obtained in the sequential comparison mode, hence enhancing the resolution by D2 to gain a high-resolution digital signal corresponding to the input analog signal $e_1$. Subsequently, the processor 20 executes computation by using the digital signal thus obtained, so that a high resolution is attained also with respect to the result of computation.

Figure 11:
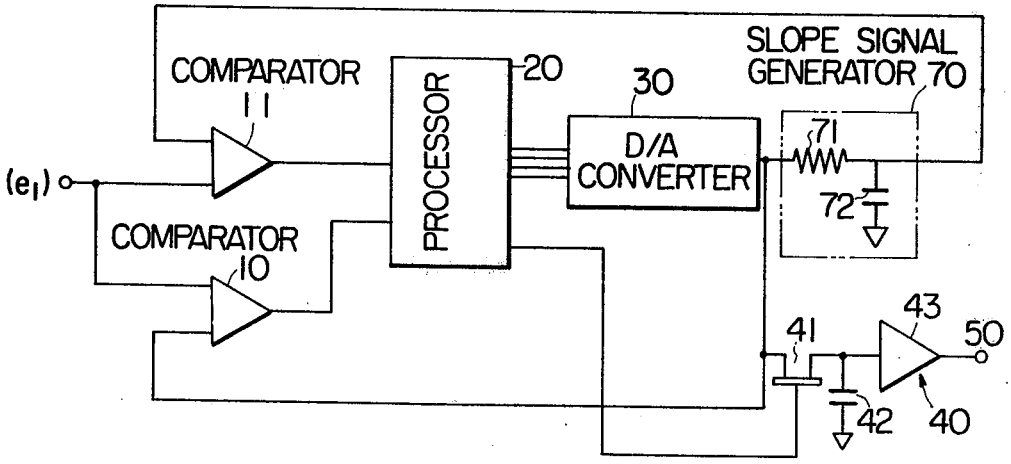

In the embodiment of FIG. 11, the input side of a processor 20 is equipped with comparators 10, 11 each of which receives an input analog signal $e_1$ through one input terminal thereof, and the output terminal of a D/A converter is connected to the other input terminal of comparator 10, while the output terminal of a slope signal generator 70 is connected to the other input terminal of comparator 11. And the output signal of comparator 11 is loaded so as to function as the switch S in the embodiment of FIG. 7. That is, in the sequential comparison mode, A/D conversion is executed at a high speed by a loop including comparator 10, processor 20 and D/A converter 30, while in the count mode, A/D conversion is executed by a loop including comparator 11, processor 20, D/A converter 30 and slope signal generator 40.

Figure 12:
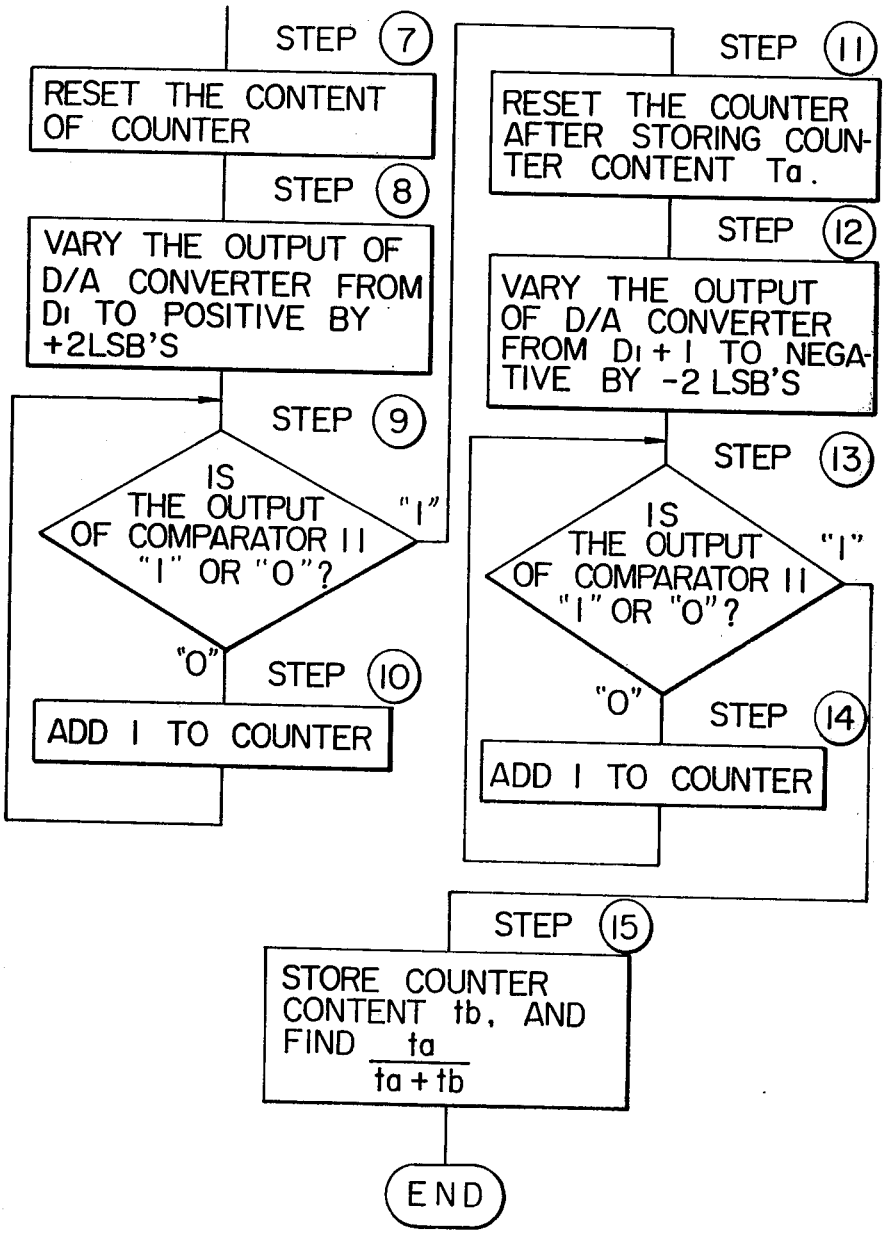
FIG. 12 is a flow chart showing an instance where, in a count mode, the output of a D/A converter is varied stepwise in both positive and negative directions by two least significant bits.
Figure 13:
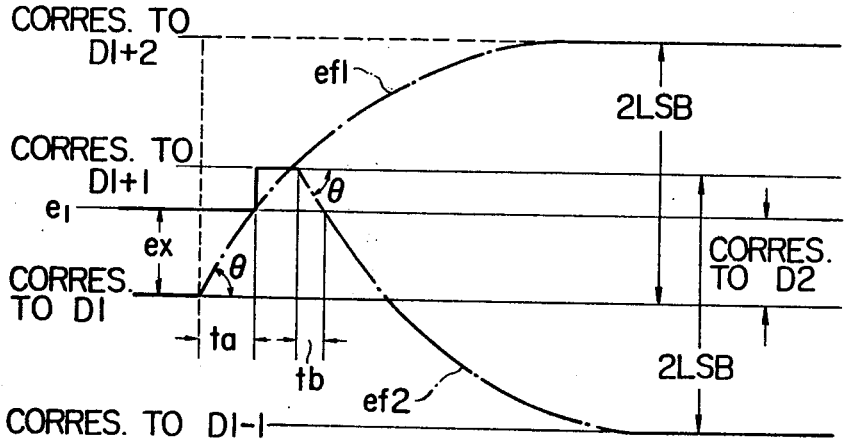
FIG. 13 plots the waveform representing the operation in FIG. 12.

FIG. 12 is a flow chart showing the procedure in the case where, at the time of A/D conversion in the count mode in the embodiment of FIG. 7 and 11, the output of D/A converter 30 is varied stepwise in both positive and negative directions by, for example, two least significant bits; and FIG. 13 plots the waveform representing the operation in FIG. 12. In the procedure from Steps (7) through (10), a positive slope signal $e_{f1}$ having an amplitude of two least significant bits is generated, and a time $t_a$ is found which is required until coincidence is attained between the positive slope signal $e_{f1}$ and an input analog signal $e_1$ after generation of the signal $e_{f1}$. Subsequently, in the procedure from Steps (11) through (14), a negative slope signal $e_{f2}$ having an amplitude of two least significant bits is generated, and a time $t_b$ is found which is required until coincidence is attained between the negative slope signal $e_{f2}$ and the input analog signal $e_1$ after generation of the signal $e_{f2}$. And at Step (15), $t_a/t_a+t_b)$ is computed to obtain a digital signal D2 in the count mode.

According to the above procedure, the slope signal obtained from the signal generator 70 is such that it changes substantially linearly with the lapse of time as plotted in FIG. 13, and the inclination angles $\theta$ of both positive and negative slope signals become equal to each other. Consequently, since $t_a+t_b$ corresponds to one least significant bit, the digital signal D2 corresponding to $e_x$ (analog value from D1 to $e_1$) can be obtained accurately by computing $t_a/t_a+t_b$. The above procedure is advantageous in the point that the accuracy of A/D conversion is not affected by a change in the value of any circuit element of slope signal generator 70 as long as symmetry is maintained in the positive and negative slope signals. Moreover, since the width of the stepwise change in the output signal of D/A converter is as large as two least significant bits, the comparing action is rendered accurate and the inclination angle $\theta$ of each slope signal is widened to accelerate the conversion speed in the count mode.

Figure 14:
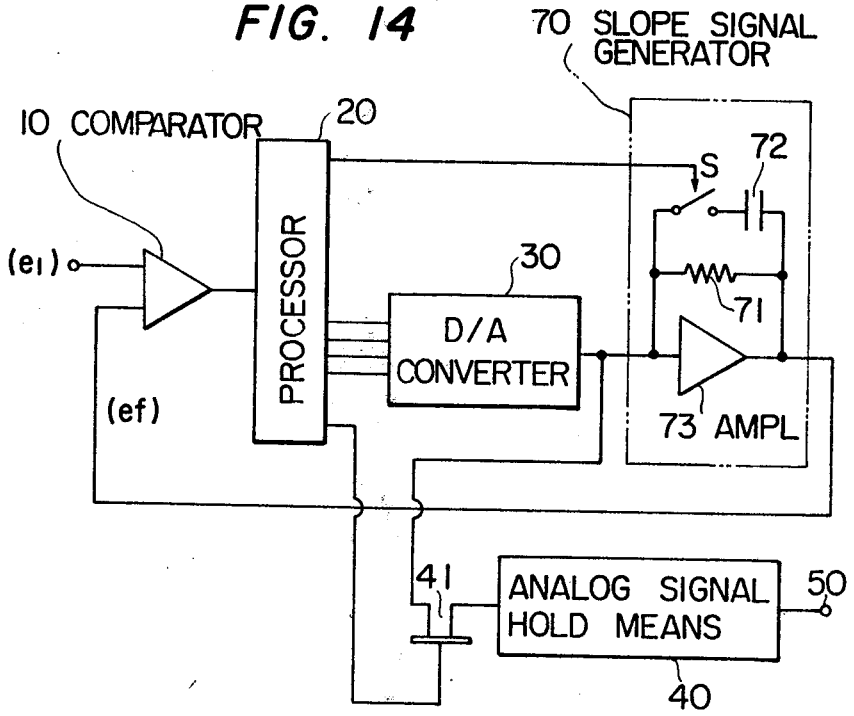

In the embodiment of FIG. 14, the D/A converter 30 employed is of the current output type, and the slope signal generator 70 comprises an amplifier 73 and a parallel circuit of a resistor 71 and a capacitor 72 connected between the input and output terminals of the amplifier 73. The switch S connected in series with the capacitor 72 serves to control timing of slope signal generation. According to this system, the slope signal obtained from the slope signal generator 70 is such that it varies linearly with the lapse of time.

In the embodiments of FIGS. 7, 11 and 14, the slope signal generator may be composed of other circuit configurations if the output signal of D/A converter is used for slope signal generation.

Thus, as mentioned hereinabove, the present invention makes it possible to implement an improved analog signal computing system of a simplified structure at low cost.

We claim:

1. An analog signal processing system comprising:

a comparator receiving an input analog signal as one input thereof;

a processor receiving the output of said comparator and having a digital output and a control signal output, said processor performing a first analog/digital conversion operation and a second digital operation during first and second parts of each of successive operating cycles;

a digital/analog converter for converting the digital output of said processor to an output analog signal, circuit means feeding said output analog signal as a second input to said comparator; and an analog signal sample and hold circuit receiving said output analog signal and responsive to a control signal from said processor to sample said output analog signal.

2. The analog signal processing system as claimed in claim 1 further comprising a slope signal generator receiving said output analog signal and feeding a slope signal to a comparator, said comparator receiving said input analog signal as another input thereof and feeding an output to said processor.

3. The analog signal processing system as defined in claim 1, comprising a plurality of comparators on the input side of the processor, each comparator respectively receiving a different input analog signal as one input thereof; and means feeding the output analog signal as another input to all said comparators in common;

said processor loading the output signals of said comparators sequentially or selectively.

4. The analog signal processing system as defined in claim 1, comprising a plurality of analog signal sample and hold circuits on the output side of the digital/analog converter, the processor feeding control signals to said analog signal sample and hold circuits sequentially or selectively.

5. The analog signal processing system as defined in claim 1, further comprising means for feeding the output of the analog signal sample and hold circuit as one input to the comparator, said analog signal sample and hold circuit being so constituted as to hold, at the occurrence of interruption of power supply, the output of the digital/analog converter immediately anterior to such power interruption, the processor loading the output of the analog signal hold means through the comparator after restoration of the power supply.

6. The analog signal processing system as defined in claim 1, further comprising an operation parameter setting circuit including a variable resistor for obtaining an analog signal, and means for feeding the signal thus obtained to the processor through the comparator.

7. The analog signal processing system as defined in claim 2, wherein said slope signal generator is an integrating circuit consisting of a resistor and a capacitor.

8. The analog signal processing system as defined in claim 2, wherein said digital/analog converter is of the current output type, and said slope signal generator comprises an amplifier and a parallel circuit of a resistor and a capacitor connected between the input and output terminals of said amplifier.

9. In an analog signal processing system comprising a comparator, a processor, and a digital/analog converter, the method of making digital computations with the digital representation of an input analog signal applied to the comparator input and of supply an output analog signal, said method comprising the steps of:

1. converting said input analog signal to a digital signal by means of the following sub-steps:
   a. applying a predetermined digital signal from said digital processor to said digital/analog converter,
   b. applying the output analog signal from the digital/analog converter to an input to the comparator;
   c. detecting the comparator output, and varying the digital representation of the input analog signal and the predetermined digital input to the digital/analog converter in accordance with the comparator output;
   d. continuing steps (b) and (c) until a predetermined resolution in the digital representation of the analog input is reached;
2. performing computations in said processor with the digital representation of the analog input; and
3. applying a digital signal resulting from said computations to said digital/analog converter and sampling the output analog signal from the digital/analog converter by an analog signal sample and hold circuit.

* * * * *